US006388699B1

(12) United States Patent
Phillips

(10) Patent No.: US 6,388,699 B1
(45) Date of Patent: May 14, 2002

(54) SHUTTER SYSTEM FOR PRINTER CARTRIDGE

(75) Inventor: Quintin T. Phillips, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/847,877

(22) Filed: May 2, 2001

(51) Int. Cl.[7] ..... B41J 2/435
(52) U.S. Cl. ..... 347/263
(58) Field of Search ..... 347/138, 263; 399/110, 111, 114

(56) References Cited

U.S. PATENT DOCUMENTS 5,261,568 A 11/1993 Corby et al. ..... 222/167
5,465,136 A * 11/1995 Watanabe ..... 399/111
6,144,398 A * 11/2000 Yokoyama et al. ..... 347/263

* cited by examiner

*Primary Examiner*—Anh T. N. Vo

(57) ABSTRACT

Embodiments of a printer cartridge with a moveable shutter for covering the organic photoconductor are shown and described. The cartridge and the cavity inside the printer, which receives the cartridge, cooperate to open the shutter, preferably when the cartridge is slid longitudinally into the printer. A protrusion and ramped recess system may be used to create the force to move the shutter, the cartridge translating the force of sliding the cartridge longitudinally into a transverse force on the shutter. In a preferred embodiment, the shutter has a protruding tab that is placed to fit into and slide along a diagonal elongated recess in the cavity wall of the printer. When the cartridge is inserted longitudinally into the printer, the force of the recess wall on the tab moves the tab and hence the shutter to open the shutter. Likewise, when the cartridge is removed from the printer, the tab movement in the recess either forces or allows the shutter to return to the closed position. Thus, insertion of the cartridge and opening of the shutter are accomplished all in one single longitudinal sliding action by the user, and do not require rotation or additional adjustment of the cartridge or the shutter.

17 Claims, 5 Drawing Sheets

SHUTTER SYSTEM FOR PRINTER CARTRIDGE

FIELD OF THE INVENTION

The present invention relates generally to cartridges for computer printers. More specifically, the invention relates to a protective cover for an organic photoconductor (OPC) and a mechanism for uncovering the OPC when it is installed for use in a printer.

BACKGROUND OF THE INVENTION

Conventional laser printers utilize one or more printer cartridges 10 that comprise an organic photoconductor roller (OPC) 12, with exposed photoconductor surface 13, as well as mechanisms necessary to produce a developed image on the OPC for transfer to paper or to an intermediate transfer belt 14. A cartridge with these mechanisms is shown schematically in FIG. 1. These cartridge mechanisms are known in the art and include a charge roller 16, a window 18 from the outside surface of the cartridge to the OPC for laser writing of a latent image on the OPC, a fresh toner reservoir or "hopper" 20, a system 22 for metering toner and applying it to the OPC to develop the latent image, and a waste toner removal mechanism and waste toner hopper 24.

Because the printer cartridge includes an OPC, which is vulnerable to damage by light, dust, or grime, the typical printer cartridge 10' includes a movable cover 11 that lies substantially over the surface (13) of the OPC 12 that extends from the cartridge housing whenever the cartridge is removed from the printer. See FIG. 2. Two rigid wire arms 15, 15' extend out from the cartridge cover 11 at each end of the cartridge 10'. The cartridge is installed into a cavity inside the printer, by moving the cartridge in a direction perpendicular to the longitudinal axis of the cartridge. As the cartridge enters the cavity, the "elbows" 17 of the two wire arms abut against shoulder surfaces in the walls forming the cavity and are thereby forced to pivot in a direction that flips the cover angularly away from the OPC to uncover the OPC. Thus, during use, the OPC is uncovered and in contact with the transfer station to transfer developed images to paper. When the conventional printer cartridge is removed from the printer, it is pulled out of the cavity, which allows the spring-biased cover to rotate to cover the OPC.

Still, there is a need for an improved printed cartridge with an improved cover for the OPC. There is a need for a cartridge that can be reliable and accurately placed inside a printer, with an OPC cover that smoothly and reliably moves out of the way for cartridge use, and moves again into place to protect the OPC upon cartridge removal.

SUMMARY OF THE INVENTION

The present invention is a mechanism for uncovering the organic photoconductor of a printer cartridge when the cartridge is installed inside the printer. The mechanism comprises a movable cover or "shutter" shaped to extend over the otherwise-exposed exposed OPC surface, and a mechanism to move the shutter relative to the OPC, powered by the force of inserting the cartridge into the printer. The mechanism may comprise a cooperating protrusion and ramped recession, wherein the "ramping" is oriented in a direction that slides the protrusion to the desired position. Preferably, the protrusion extends from the shutter, and the recession is in a surface of the printer cavity that guides the shutter to open when the cartridge is being moved into the printer. Alternatively, the protrusion may extend from the cavity surface and the ramped recess may be located on the exterior of the shutter.

Preferably, a tab extending out from the shutter is received in a slot in an inside printer surface and slides along the slot during cartridge insertion. The slot is slanted or "ramped" relative to the direction of travel of the cartridge so the tab, retained in the slot, applies force on the shutter to move it away from the OPC. Thus, insertion of the cartridge causes the shutter to open and reveal the OPC. In reverse, removal of the cartridge causes or allows the tab to again slide along the slot, but in a reverse direction from the insertion direction, closing the shutter to cover the OPC.

The shutter opening mechanism and closing mechanism may therefore be entirely actuated by the movement of the cartridge into and out of the printer, and may require no other power source. Alternatively, spring-biasing may be added to assist in smooth and non-jamming movement.

Preferably, the invented mechanism is utilized on a printer cartridge that is adapted to slide longitudinally into the printer. By "longitudinally" is meant the direction parallel to the long dimension of the cartridge and parallel to the rotational axis of the OPC. With this orientation, a small tab protruding out from a portion of a shutter can slide in a slanted slot that extends at an angle to the OPC axis and at the same angle to the direction of cartridge insertion.

The shutter may be of various types of construction, including generally rigid, generally flexible, or a combination of rigid and flexible. Flexible embodiments may require supporting or guiding structure to space the shutter from the sensitive OPC and to provide for movement of the flexible shutter relative to the OPC without touching the OPC, to help prevent scratching and wear of the OPC.

DETAILED DESCRIPTION OF THE INVENTION

Figure 1:
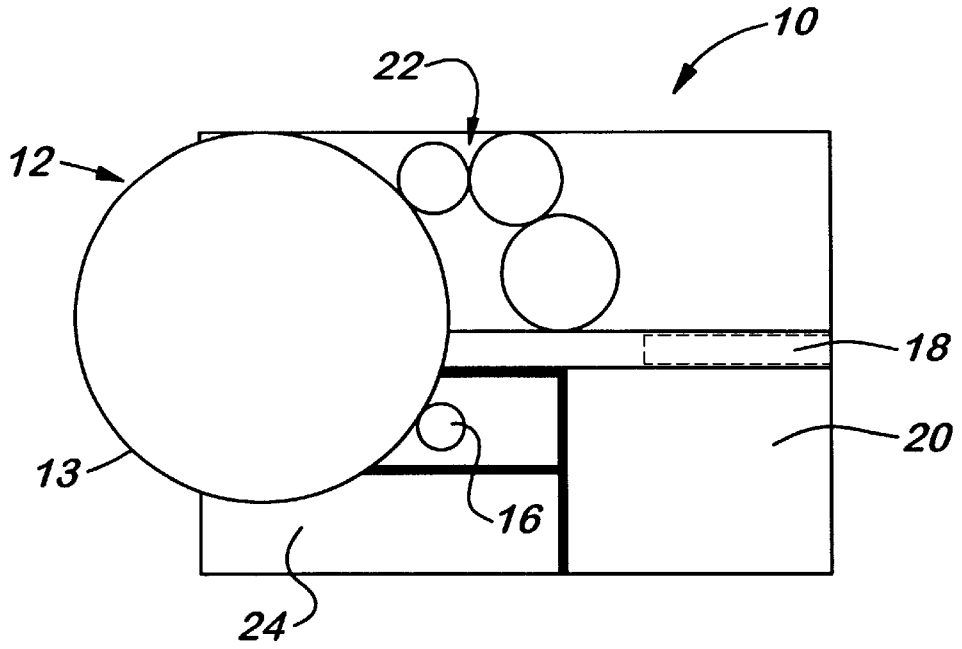
Fig. 1 (PRIOR ART)
FIG. 1 is a schematic view of the internal structure of one type of prior art printer cartridge.
Figure 2:
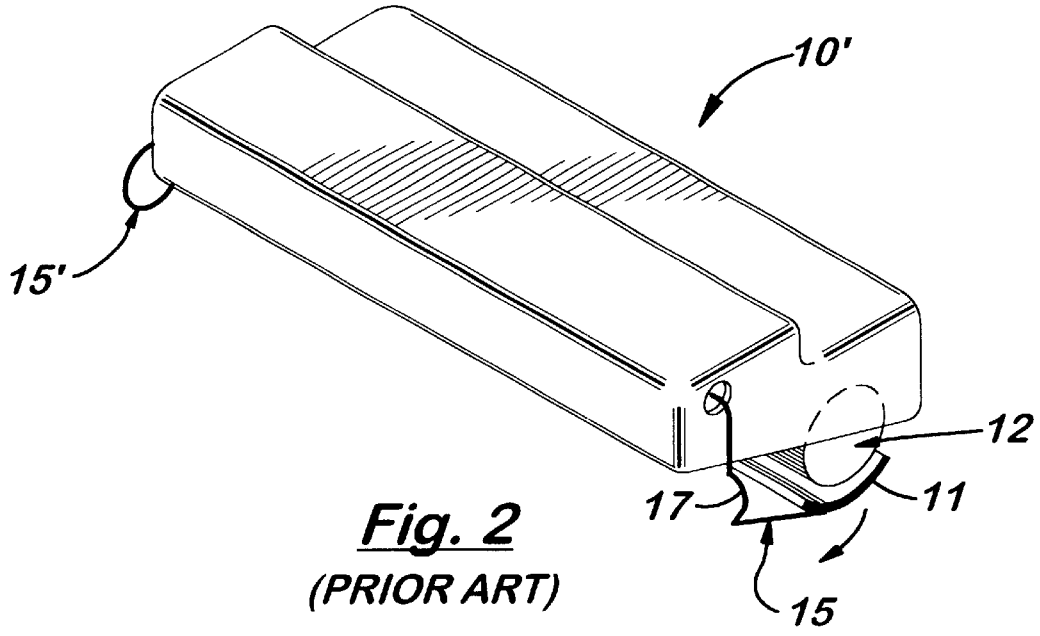
Fig. 2 (PRIOR ART)
FIG. 2 is perspective view of one prior art cartridge for a printer, with a pivotal wire arm mechanism for opening a shutter.

Referring to the Figures, there are shown several, but not the only, embodiments of the invented shutter opening mechanism for a printer cartridge. FIGS. 1 and 2 illustrate the internal and external structure of a prior art cartridge that is inserted transversely to its longitudinal axis into a printer. The prior art cartridge is described in Related Art, above. FIGS. 3–7 illustrate cartridges according to the invention that may be inserted longitudinally into a printer and that include embodiments of the invented protrusion and ramped recess system for opening a shutter.

The invented cartridge 50 may have internals, and may operate, like those of a conventional cartridge 10. The OPC 12 is an elongated roller of photoconductive material, as known in the art of laser printing. The OPC is rotatably mounted inside a housing 52 with about half of the OPC surface (exposed photoconductor surface 13) extending out from the housing 52 for contact with an image transfer station inside the printer. The housing is portrayed herein as generally rectangular with a front side 54, rear side 56, first end 58, second end 60, top side 62 and bottom side 64. A rectangular housing shape is not required, and the inventor envisions that other shapes may be used, provided that the tab and ramped recess members are positioned, during the entire process of cartridge insertion, to create the appropriate force on the shutter without jamming or substantial wear. An efficient way to ensure this is to maintain the tab ramped recess in parallel planes through the insertion process; this is most easily done with the tab moving on a flat housing surface.

The terms "top," "bottom," etc., are used for clarity and to match the orientation of the cartridge in the drawings, but not to limit the cartridge to a particular orientation in the printer 1. One may envision, after seeing this disclosure, that the cartridge may be inserted into cooperating printer cavities in various orientations relative to the surface on which the printer is sitting, that is, various orientations relative to gravity. For example, the inventor envisions various arrangements of printer internals with the invented cartridge sliding into the printer with its OPC facing upwards, downwards, or to any side as long as the cartridge internals are also adapted to properly charge, expose, develop, and clean. The invented tab and slot system could be applied to a cartridge that orients the exposed photoconductor surface to be at the top surface of the cartridge, on the same side as the shutter; the shutter would then slide across, the top surface of the cartridge adjacent to the photoconductor. Or, as a further example, the invented tab and slot system could be applied to a cartridge that orients the exposed photoconductor surface to be at the "bottom" of the cartridge and the shutter would then slide across, the bottom surface of the cartridge adjacent to the photoconductor. The axis of the OPC is herein also called the "longitudinal axis" and the longitudinal axis of the cartridge is defined as parallel to the OPC axis.

Shutter 70 covers the OPC during storage and transport. The shutter preferably, but not necessarily, curves around the exposed surface of the OPC at slightly greater than the radius of the OPC, so that the shutter 70 does not touch the OPC when covering the OPC or when moving away to uncover the OPC. Preferably, the shutter 70 does not touch the OPC at any point, but does substantially cover the OPC so that the OPC is not exposed to significant light, dust, or damage. The shutter 70 may contact part of the housing or guide structure at the ends of the OPC, but the shutter does not need to seal, and preferably does not seal, against the housing around the OPC. Therefore, there is a gap between the shutter and the OPC and there is likely to be a gap between the shutter and the housing on at least one edge 71 of the shutter and more likely on at least three edges of the shutter. The shutter does not need to include any liquid or powder sealing mechanism, as the shutter is merely a mechanical cover to shield the OPC from damage and does not prevent any material from falling out of the cartridge.

The shutter 70 includes a shield portion 72 which is preferably approximately a half-cylinder, which curves around and shields the OPC. The shutter also includes an extension portion 74, which extends rearward along the top surface of the cartridge. Various extension portions 74 may be designed, but the preferred embodiment is a generally rigid plate parallel to, and slidable on, the top surface 62 of the cartridge. The extension portion 74 integrally connects to the shield portion 72 all along the length of the shield portion and extends rearward about halfway between the front and rear sides of the cartridge to the "midline" M. In alternative embodiments, extension portions may be differently-shaped and connected in various ways, provided that the extension portion firmly, accurately, and reliably pulls on the shield portion to displace it rearwards away from the OPC and then pushes on the shield portion in reverse to recover the OPC. For example, instead of a large, continuous plate serving as the extension portion 74, one or more elongated bars may attach to the shield portion 72 and extend rearward perpendicularly to the cartridge longitudinal axis L to about the midline M.

A connecting/guiding mechanism (not shown) is included to hold the shutter on the cartridge housing, while allowing the shutter to move. For example, a connecting/guiding mechanism may slidably connect the extension portion 74 to the top side 62 so that the extension portion 74 may slide rearward and forward parallel to the top side. This mechanism is not shown in the drawings, as it is within the skill of one in the art to design after seeing this Description.

Figure 6:
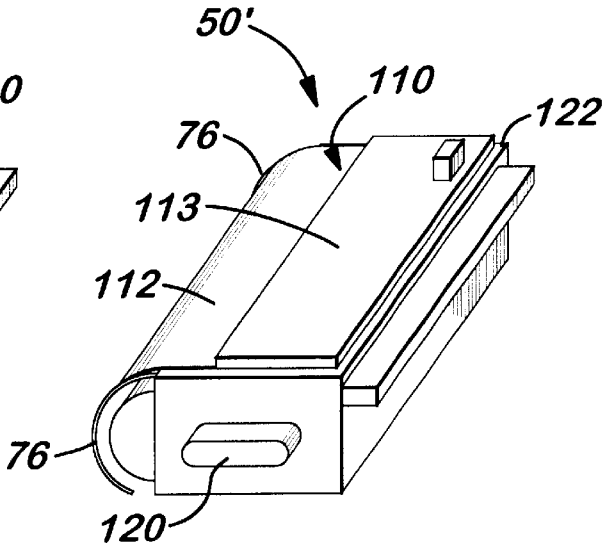
FIG. 6 is a perspective view of an alternative cartridge according to the invention with a flexible shutter in the open position.

A support/guide mechanism may be included for the shield portion 72 to space it from the OPC and/or to guide it during movement. Rigid embodiments of the shield portion 72 may not need such a support/guide mechanism besides the inherent rigidity of such a shield portion 72 and its placement are adapted so that the shutter cannot flap or move against the OPC. Flexible embodiments of the shield portion 72, as shown in FIG. 6, may require a support/guide mechanism to support the flexible panel of the shield portion 72 out and away from the OPC. For example, as shown in FIG. 6, two curved ribs 76 may extend coaxially with the OPC at a radius greater than the OPC. These ribs 76 are preferably distanced out past the ends of the OPC sufficiently so that the ribs do not interfere with the OPC.

The printer has an opening 80, preferably at a side, into internal cavity 82 for receiving the cartridge. The opening 80 and/or cavity 82 have structure that cooperates with the cartridge structure to ensure that the cartridge slides accurately and properly into proper alignment with the internals of the printer with which the cartridge must cooperate for printing. For example, the cartridge may include a key 84 which protrudes out from the rear side, parallel to the longitudinal axis of the OPC and the cartridge. A matching female key structure 86 is preferably included in the opening 80 and cavity 82, to guide the key 84 and, hence, the entire cartridge, into the cavity. Other keying or support structure may be included for proper placement of the cartridge and is not known here as it would be within the skill of one designing printers. Once the cartridge is fully inserted into the printer, a housing door (not shown) may be closed over the opening 80.

The preferred cartridge and cartridge-receiving printer are designed so no further movement of the cartridge relative to the printer is needed once the cartridge is slid in a single longitudinal direction into the printer. For example, no rotation of the cartridge on its longitudinal axis is needed, no turning or twisting of the cartridge is needed, and no additional shutter movement is needed. Once the cartridge is installed with the preferred single longitudinal sliding action, the uncovered OPC is correctly placed for cooperation with a transfer station/belt and printing operation, and the cartridge is ready for use.

A tab 90 protrudes from the extension portion 74 a distance from the top surface 92 of the extension portion that allows it to be received in a corresponding slot 94 in the opening 80 and cavity 82. Preferably, the tab is a small bump, bar, cylinder, or other protrusion that is preferably about as wide (from its front side to its rear side) and long (from its first end to its second end) as it is tall, or that has a diameter about as large at it is tall. The tab 90 width is less than the width between the two sidewalls of the slot, and the tab length is preferably also less than the width of the slot, so that the tab does not jam in the slot.

The slot 94 extends from the opening 82 through the cavity, preferably in a single plane parallel to and slightly above the planes of both the top side 62 and the extension portion. Preferably, the slot 94 is a three-sided channel, that is, with base wall and two side walls (front wall 96 and rear wall 124). The slot 94 preferably extends diagonally along the top surface 93 of the cavity from nearer the front area 95 of the cavity that receives the photoconductor to nearer the rear area 97 of the cavity that receives the rear side of the cartridge. To cooperate with the cartridge embodiment illustrated in FIGS. 3–5, the slot originates at about the midline of the cavity and extends at an angle to near the rear, inner corner of the cartridge cavity, in preferably a straight line. The resulting slot 94, therefore, may be explained as a "ramp" leading toward the rear of the cavity.

Figure 3:
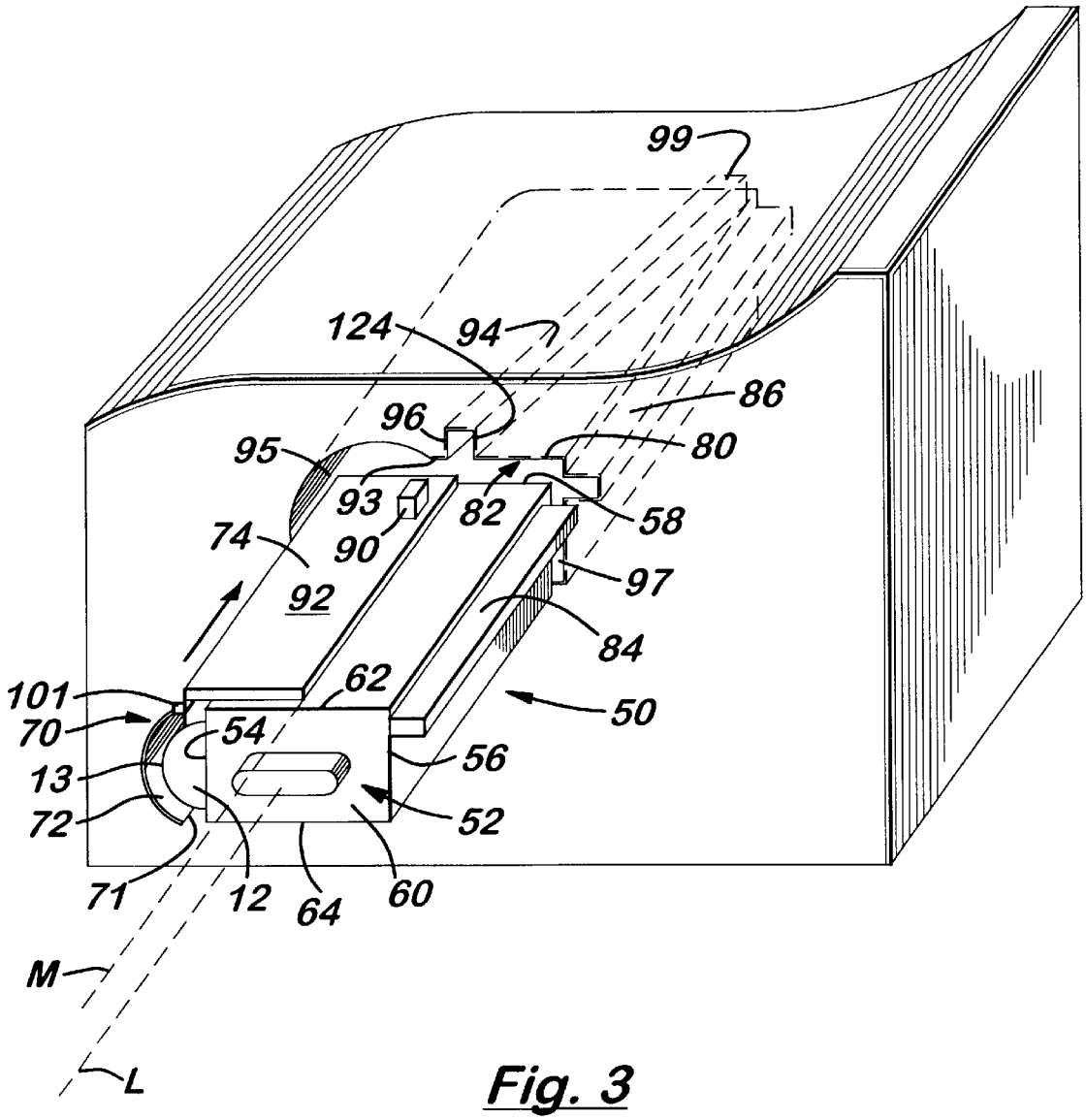
FIG. 3 is perspective side view of one embodiment of the invented cartridge, with the shutter closed, being inserted longitudinally into one embodiment of a laser printer.
Figure 4:
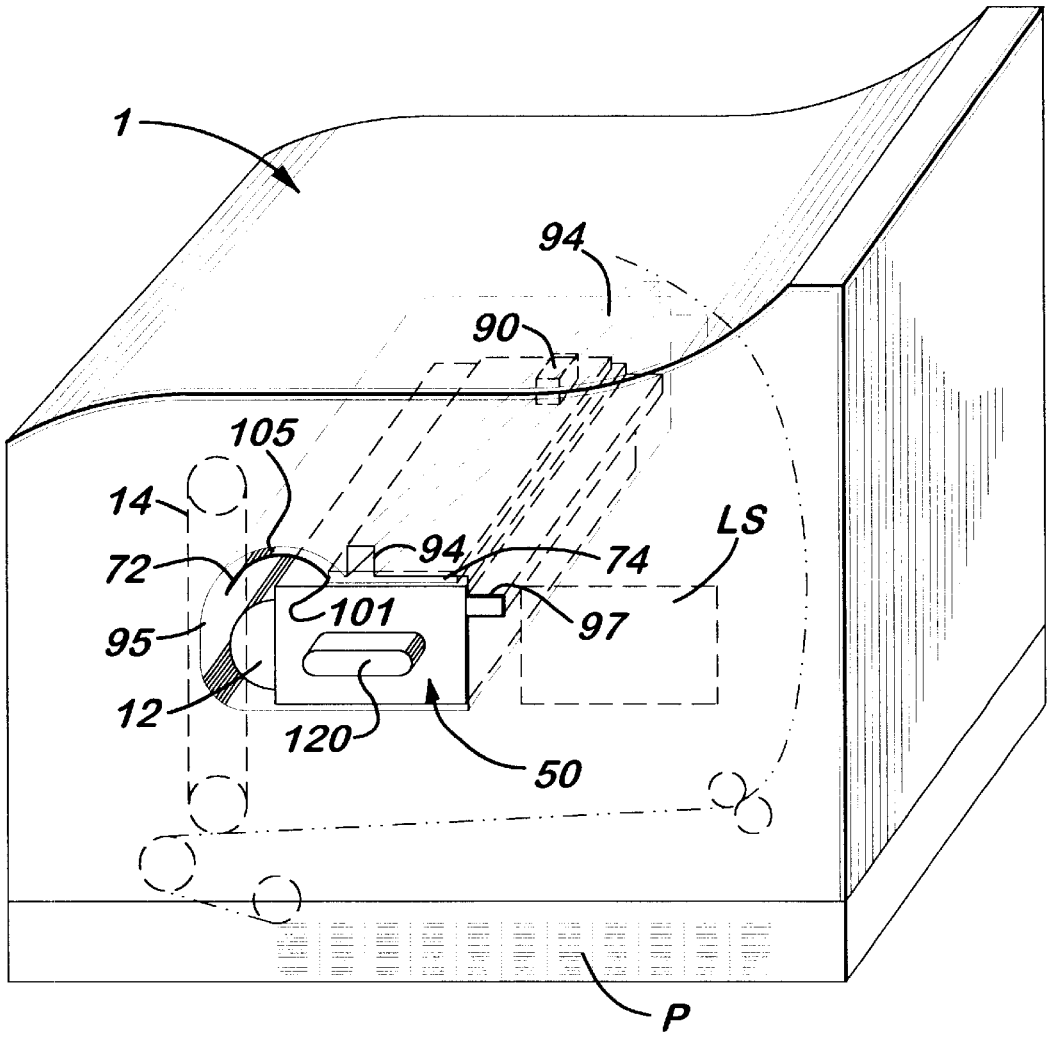
FIG. 4 is a schematic side view of the cartridge of FIG. 3 fully inserted into the printer, with the shutter open and with only the outer end of the cartridge showing.
Figure 7:
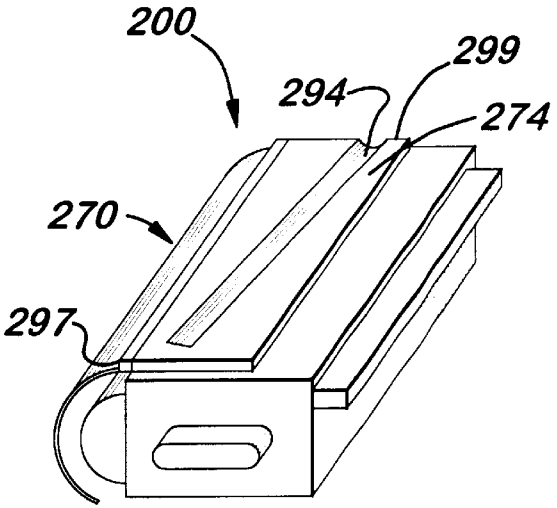
FIG. 7 is a perspective view of an alternative cartridge according to the invention with a ramped recess in the shutter.
Figure 5:
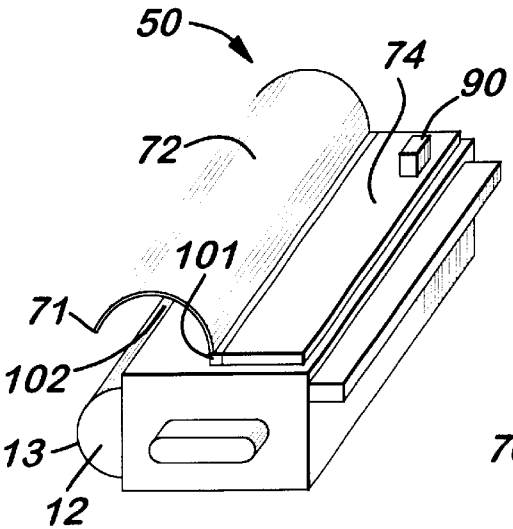
FIG. 5 is a perspective view of the cartridge of FIGS. 3 and 4 with the shutter opened.

FIG. 3 illustrates one embodiment of cartridge 50 according to the invention ready to be inserted into a printer. The cartridge 50 is matched up with the opening 80 in the side of the printer, and is then slid straight along its longitudinal axis into the printer to the position shown in FIG. 4. The tab 90 aligns with the opening end of the slot 94 and is received therein. As the cartridge is pushed farther into the cavity, the tab 90 slides farther into the slot 94, and, because of the angled, "ramped" nature of the slot 94, the tab 90 is forced rearward by the wall(s) of the slot. Typically, during insertion of the cartridge, the tab 90 slides along the forward wall 96 of the slot, in effect, pushing the tab rearward, and the entire shutter along with it. Once the cartridge is filly inserted into the cavity, the tab 90 is generally at the rear, inner end 99 of the slot, and the shutter is slid rearward, with the shield portion up and off of the OPC, as illustrated in FIGS. 4 and 5.

Various systems may be used to move the shield portion off of the shutter. In embodiments wherein the shield portion is a rigid member, the extension portion is preferably hinged to the shield portion, for example, at hinge 101. When the extension portion is pulled back rearward, the shield portion is also pulled rearward, and, when it impacts on a portion of the housing, preferably the front edge 102 of the top side, the shield portion pivots upward at its hinge 101. The front edge 102 extends forward enough so that the shield portion abuts against it rather than against the OPC, and the shield portion slides rearward over the front edge 102 and the front area of the top side. Such an embodiment requires clearance in the opening 80 and the cavity 82 for the pivoting, rigid shield portion as it swings up from its position at the front side of the cartridge (FIG. 3) to its position at the top side of the cartridge (FIGS. 4 and 5). The clearance may take the form of a larger opening 105 and larger cavity space in the area where the shield portion travels.

Alternative embodiments of the invented cartridge may have a shutter having at least a portion that is flexible material. For example, FIG. 6 illustrates a cartridge 50' with a shutter 110 having a flexible shield portion 112 and extension portion 113 that is preferably, but not necessarily, rigid. This shield portion 112 is flexible in the direction perpendicular to the OPC axis ("transversely"), so that when the shutter is closed, the flexible shield portion curves around the OPC, supported by ribs 76 that supports and guides the flexible portion but that do not interfere with OPC movement and operation. When the shutter is pulled rearward, the flexible portion travels rearward on the ribs toward the top side of the cartridge, without touching the OPC. Preferably, the shield portion does not significantly flex along the longitudinal direction, so that it does not sag in its middle toward the OPC. The flexible shield portion may be hinged to the extension portion, or may instead rely on its transverse flexibility to bend/pivot relative to the extension portion. FIG. 6 illustrates the flexible shutter retracted and flexed to lie substantially flat on top of the top side of the cartridge, rather than arching substantially upward as in the rigid embodiment of FIG. 5.

When the cartridge is removed, the door (not shown) over the opening 80 may be opened, and the cartridge may be pulled out by means of a handle 120. As with the installation, the preferred cartridge is removed entirely longitudinally, by sliding the cartridge straight out of the printer. During removal, the tab 90 near the rearward and inward corner 122 of the cartridge travels forward and outward along the slot 94. The rear wall 124 of the slot 94 acts as the "ramp" for the tab 90, whereby the tab 90 abuts and slides against the rear wall 124, thus forcing the tab and the extension portion 74 forward to close the shutter. By the time the cartridge is fully removed from the printer, the shutter is closed and in the position shown in FIG. 4.

Preferably, there is sufficient frictional resistance in the shutter movement, that the shutter does not slide open or closed except during installation or removal, and except when a user purposely moves the shutter. While such an embodiment of cartridge does not require biasing of the shutter into the closed position, biasing (not shown) may be a desirable option. With the shutter biased into a closed position, for example, by a spring mechanism, the shutter position would be more sure during transport and handling. With shutter biasing, installation of the cartridge would act against the biasing, so that the tab 90 would slide against the front wall 96 of the slot substantially as described above. During removal, however, the biased shutter would preferentially move to the closed position, so the tab would be expected to travel along the slot also against the front wall of the slot, as shutter closure would be powered by the biasing rather than by the rear wall 124 pushing on the tab.

Many other embodiments are envisioned by the inventor. Other embodiments may include a slot that is not straight, but that curves at one or more radii, provided that both straight slots and curved slot are substantially non-parallel to the longitudinal axis of the cart. Also, a tab and slot may be located nearer the front of the cartridge and cavity, for example, in cases where the tab and slot may be close to each other all along the front half of the top side because no large clearance (IOS) is needed for a flipped-up rigid shield portion.

Other cartridges 200 may be adapted to place the elongated slot 294 in an outer surface 296 of the shutter 270 and the tab in the printer cavity wall. The preferred slot 294 extends diagonally across the extension portion 274 of the shutter, from generally near the front outer corner 297 to the rear inner edge 299 of extension portion 274. See, for example, the cartridge in FIG. 7.

Figure 8:
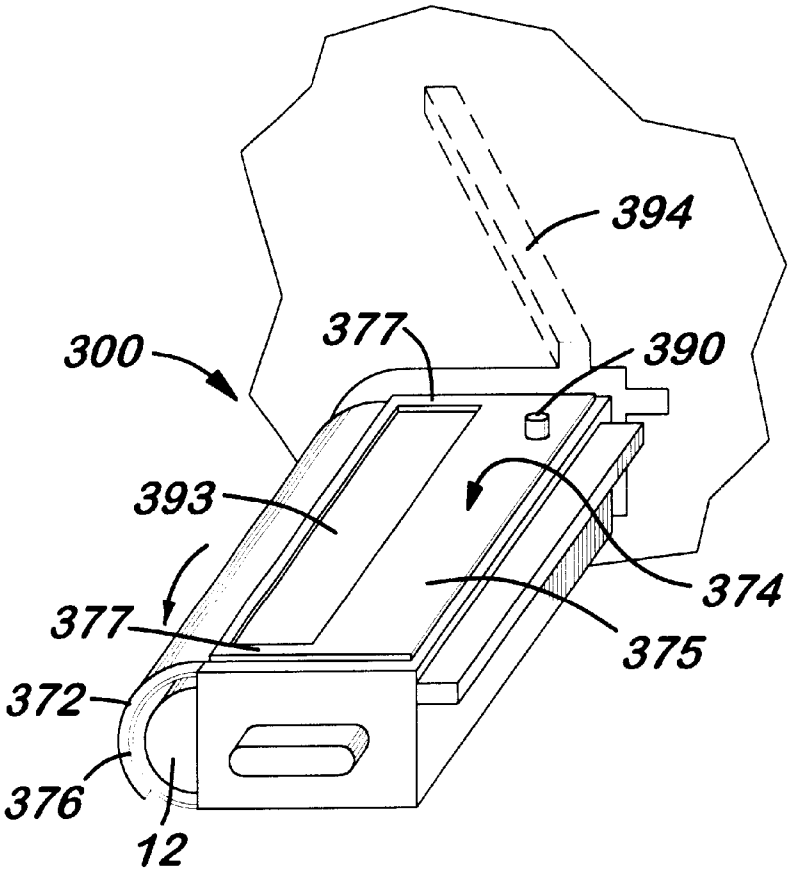
FIG. 8 is a perspective view of an alternative cartridge according to the invention with a push-to-open shutter.

Other cartridges 300 may be adapted to have a tab 390 and slot 394 system that pushes the shutter open and pulls the shutter closed. This could be accomplished with the tab 390 being positioned at or near the rear edge of the extension portion 374 and slidable in a slot 394 angling from the rear of the cavity toward the inner, front corner of the cavity. An extension portion of the shutter with a rear bar 375 and tab 390 moves forward to push narrow, transverse straps 377 (which extend on either end of a window 393), which in turn moves window 393 over the OPC to "open" the shutter and expose the OPC. The shutter portion 372 would be adapted to slide across the OPC on support/guide structure 376 to place the window 393 around the OPC in a manner that will not interfere with the OPC during printing operation. See, for example, the cartridge in FIG. 8.

Figure 9:
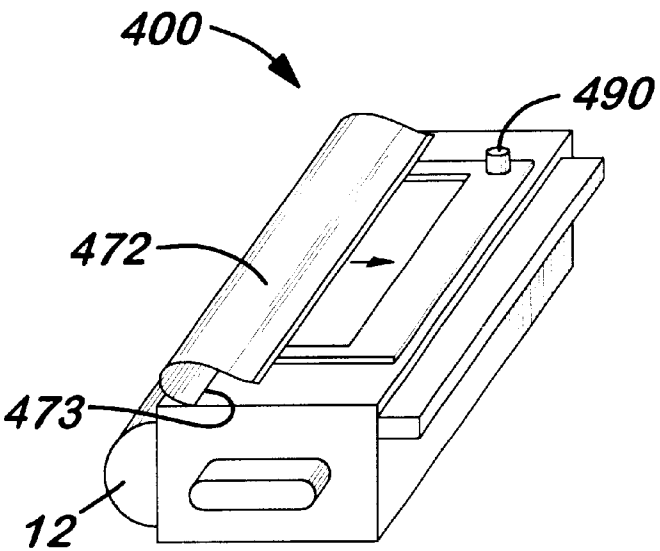
FIG. 9 is an end view of a cartridge with a peel-away shutter open according to another embodiment of the invention.

Other cartridges 400 may be adapted to peel away a flexible shutter 472, that is connected to the top surface of the cartridge at connection 473, and that curls up and away from the OPC. See, for example, the cartridge in FIG. 9. The flexible shutter is curled up by a tab 490 and slot system, as may be understood by the description of other embodiments of the invention.

It is envisioned that the tab and slot system may be included in many configurations and locations on the cartridge and in the printer cavity. It is preferred, but not absolutely necessary, that the tab and slot be positioned at an area where the slot can be in a single-plane cavity surface parallel to a single-plane plate of the cartridge from which the tab protrudes. This way, the movement of the tab and the shape of the slot is simple and predictable—movement in one direction (one-dimensional) along a straight slot or movement in at most two directions (two-dimensional) along a curved slot on a single plane. This "one or two dimensional" style of tab and slot is less likely to be jammed or damaged when compared to less preferred "three-dimensional" tab and slot embodiments, in which the tab is on the shield portion and the tab must move in a spiral-shaped slot cylindrical cavity surface, for example.

Additional embodiments may be used to protect other components of printers that may suffer environmental or handling damage. Other printer components may be adapted to slide into a computer printer in a substantially unidirectional manner, which may allow a tab and slot system as in this disclosure to open a shutter or other protective cover.

Although this invention has been described above with reference to particular means, materials and embodiments, it is to be understood that the invention is not limited to these disclosed particulars, but extends instead to all equivalents within the scope of the following claims.

I claim:

1. A printer cartridge shutter system comprising a printer cartridge having a longitudinal axis and a printer interior wall surrounding and defining a cavity that receives the printer cartridge for printing operation, the cavity having a longitudinal axis parallel to the cartridge longitudinal axis, the printer cartridge comprising:

a housing;

a photoconductor in the housing and having an exposed photoconductor surface extending out from the housing;

a shutter connected to the housing and moveable to a closed position substantially covering said exposed photoconductor surface and moveable to an open position not covering the exposed photoconductor surface;

the shutter having a protrusion extending out from the shutter; and the printer interior wall having:

an elongated recess receiving the shutter protrusion when the cartridge is slid into the cavity, wherein the elongated recess extends at an angle to the longitudinal axis of the cavity and the printer cartridge, so that, when the cartridge is slid longitudinally into the cavity, the protrusion slides along the recess and moves the shutter to the open position.

2. A printer cartridge shutter system as in claim 1, wherein the shutter does not touch the exposed photoconductor surface.

3. A printer cartridge shutter system as in claim 1, wherein the shutter is distanced from the housing on at least one edge of the shutter and the shutter does not seal to the housing around the photoconductor.

4. A printer cartridge shutter system as in claim 1, wherein the elongated recess is a three-walled channel.

5. A printer cartridge shutter system as in claim 1, wherein the cavity has a front area that receives the photoconductor and rear area opposite the front area that receives a part of the cartridge housing, and wherein the elongated recess extends from near the front area to near the rear area.

6. A printer cartridge shutter system as in claim 1, wherein the photoconductor is a roller at a front side of the cartridge and parallel to the longitudinal axis of the cartridge and wherein the shutter comprises a shield portion adapted to curve over the exposed photoconductor surface and an extension portion extending perpendicularly to the photoconductor toward a rear side of the cartridge, the protrusion extending from the extension portion.

7. A printer cartridge shutter system as in claim 6, wherein the shutter shield portion is rigid and is pivotally hinged to the extension portion.

8. A printer cartridge shutter system as in claim 6, wherein the shutter shield portion is flexible.

9. A printer cartridge shutter system comprising a printer cartridge having a longitudinal axis and a printer interior wall surrounding and defining a cavity that receives the printer cartridge for printing operation, the cavity having a longitudinal axis parallel to the cartridge longitudinal axis, the printer cartridge comprising:

a housing;

a photoconductor in the housing and having an exposed photoconductor surface extending out from the housing; and a shutter connected to the housing and moveable to a closed position substantially covering said exposed photoconductor surface and moveable to an open position not covering the exposed photoconductor surface;

the shutter having an outer surface with an elongated recess extending non-parallel to the longitudinal axis of the cartridge and having a length; and the printer interior wall having a protrusion extending into the shutter elongated recess and sliding along the length of the elongated recess when the cartridge is slid into the cavity to force the shutter to move to the open position.

10. A printer cartridge shutter system as in claim 9, wherein the shutter does not touch the exposed photoconductor surface.

11. A printer cartridge shutter system as in claim 9, wherein the shutter is distanced from the housing on at least one edge of the shutter and the shutter does not seal to the housing around the photoconductor.

12. A printer cartridge shutter system as in claim 9, wherein the elongated recess is a three-walled channel.

13. A printer cartridge shutter system as in claim 9, wherein the photoconductor is a roller at a front side of the cartridge and parallel to the longitudinal axis of the cartridge and wherein the shutter comprises a shield portion adapted to curve over the exposed photoconductor surface and an extension portion extending perpendicularly to the photoconductor toward a rear side of the cartridge, the elongated recess extending generally diagonally across the extension portion.

14. A printer cartridge shutter system as in claim 13, wherein the shutter shield portion is rigid and is pivotally hinged to the extension portion.

15. A printer cartridge shutter system as in claim 13, wherein the shutter shield portion is flexible.

16. A method of installing a printer cartridge into a printer, the method comprising:

providing a cartridge having a housing and a photoconductor surface extending out from the housing, and a shutter moveable to a closed position over the photoconductor surface and to an open position uncovering the photoconductor surface, and the cartridge having a longitudinal axis;

inserting the cartridge into a cavity of a printer only by sliding the cartridge longitudinally; and opening the shutter simultaneously with inserting the cartridge into the cavity by providing a protrusion on the shutter that slides along an elongated slot in the cavity wall when the cartridge moves only longitudinally, thereby forcing the protrusion in a direction that opens the shutter.

17. A method of installing a printer cartridge into a printer, the method comprising:

providing a cartridge having a housing and a photoconductor surface extending out from the housing, and a shutter moveable to a closed position over the photoconductor surface and to an open position uncovering the photoconductor surface, and the cartridge having a longitudinal axis;

inserting the cartridge into a cavity of a printer only by sliding the cartridge longitudinally; and opening the shutter simultaneously with inserting the cartridge into the cavity by providing a protrusion on the cavity wall that slides along an elongated recess on the shutter that is non-parallel to the longitudinal axis when the cartridge moves only longitudinally, thereby forcing the shutter to open.

* * * * *